US012379117B2

(12) United States Patent
Bogart

(10) Patent No.: US 12,379,117 B2
(45) Date of Patent: Aug. 5, 2025

(54) EXHAUST VENT

(71) Applicant: Michael M. Bogart, Boynton Beach, FL (US)

(72) Inventor: Michael M. Bogart, Boynton Beach, FL (US)

( * ) Notice: Subject to any disclaimer, the term of this patent is extended or adjusted under 35 U.S.C. 154(b) by 213 days.

(21) Appl. No.: 17/199,094

(22) Filed: Mar. 11, 2021

(65) Prior Publication Data

US 2021/0404677 A1 Dec. 30, 2021

Related U.S. Application Data

(60) Provisional application No. 63/045,875, filed on Jun. 30, 2020.

(51) Int. Cl.

| | |
|---|---|
| ***F24F 7/04*** | (2006.01) |
| ***F24F 7/00*** | (2021.01) |
| ***F24F 13/14*** | (2006.01) |

(52) U.S. Cl.

CPC ..... *F24F 7/04* (2013.01); *F24F 13/14* (2013.01); *F24F 2007/001* (2013.01)

(58) Field of Classification Search

CPC ..... F24F 7/04; F24F 13/14; F24F 2007/001; F24F 13/08; F24F 13/18; F24F 7/10; F24F 2007/0025; F23L 17/06

See application file for complete search history.

(56) References Cited

U.S. PATENT DOCUMENTS

| | | | | |
|---|---|---|---|---|
| 5,662,522 A * | 9/1997 | Waltz | F24F 7/02 454/367 |
| 5,916,023 A * | 6/1999 | Meyer | D06F 58/14 34/235 |
| 8,528,271 B1 * | 9/2013 | Hemmer | E04D 13/178 52/95 |
| 2005/0003755 A1 * | 1/2005 | Koessler | F24F 13/08 454/359 |

FOREIGN PATENT DOCUMENTS

| | | | | |
|---|---|---|---|---|
| CA | 2521798 A1 * | 3/2007 | ..... | F24F 13/084 |
| CA | 2792809 A1 * | 4/2014 | ..... | F24F 13/06 |
| WO | WO-2015142202 A1 * | 9/2015 | ..... | E06B 7/10 |

* cited by examiner

*Primary Examiner* — Edelmira Bosques
*Assistant Examiner* — Brett Peterson Mallon
(74) *Attorney, Agent, or Firm* — Michael J. Corrigan

(57) ABSTRACT

An exhaust vent is provided including a first portion inserted through an opening in an outer wall of a structure for fluidly connecting to an appliance to be vented within the structure, a second portion fluidly connected to the first portion at a junction and having an open end opening into the atmosphere, a flap disposed at the junction configured to open by pressure from exhaust air directed through the first portion from the appliance and allow the exhaust air to pass through the second portion and be vented through the open end to the atmosphere, and the flap is further configured to close by gravity to seal the junction between the first and second portions when no exhaust air is directed through the first (Continued)

portion from the appliance to prevent back airflow from the atmosphere through the open end through the second portion to the first portion.

18 Claims, 5 Drawing Sheets

EXHAUST VENT

RELATED APPLICATIONS

This application claims benefit of U.S. provisional patent application No. 63/045,875 filed on Jun. 30, 2020.

FIELD OF THE INVENTION

The present invention relates to a building materials and components, and more particularly, to an improved exhaust vent for devices including appliances for directing exhaust air from the device to the exterior of a structure.

BACKGROUND OF THE INVENTION

Exhaust vents for directing exhaust air from devices including appliances to the exterior of a structure are known in the art. Typically, these exhaust vents are made from materials of poor quality and over time corrode in salt laden environments and are often easily damaged requiring costly early replacement. Moreover, because of poor design these prior art exhaust vents may fail over time and become ineffective at preventing backflow of wind and rain especially during extreme weather such as hurricanes and rain storms. The present invention overcomes and prevents these drawbacks and others not addressed by the prior art.

SUMMARY OF THE INVENTION

In an embodiment, an exhaust vent is provided including a first portion inserted through an opening in an outer wall of a structure for fluidly connecting to an appliance to be vented within the structure, a second portion fluidly connected to the first portion at a junction and having an open end downwardly directed and opening into the atmosphere, and a flap disposed at the junction configured to open by pressure from exhaust air directed through the first portion from the appliance and allow the exhaust air to pass through the second portion and be vented through the open end to the atmosphere.

In an embodiment, an exhaust vent is provided including a first portion inserted through an opening in an outer wall of a structure for fluidly connecting to an appliance to be vented within the structure, a second portion fluidly connected to the first portion at a junction and having an open end opening into the atmosphere, a flap disposed at the junction configured to open by pressure from exhaust air directed through the first portion from the appliance and allow the exhaust air to pass through the second portion and be vented through the open end to the atmosphere, and the flap is further configured to close by gravity to seal the junction between the first and second portions when no exhaust air is directed through the first portion from the appliance to prevent back airflow from the atmosphere through the open end through the second portion to the first portion.

DETAILED DESCRIPTION

Figure 1:
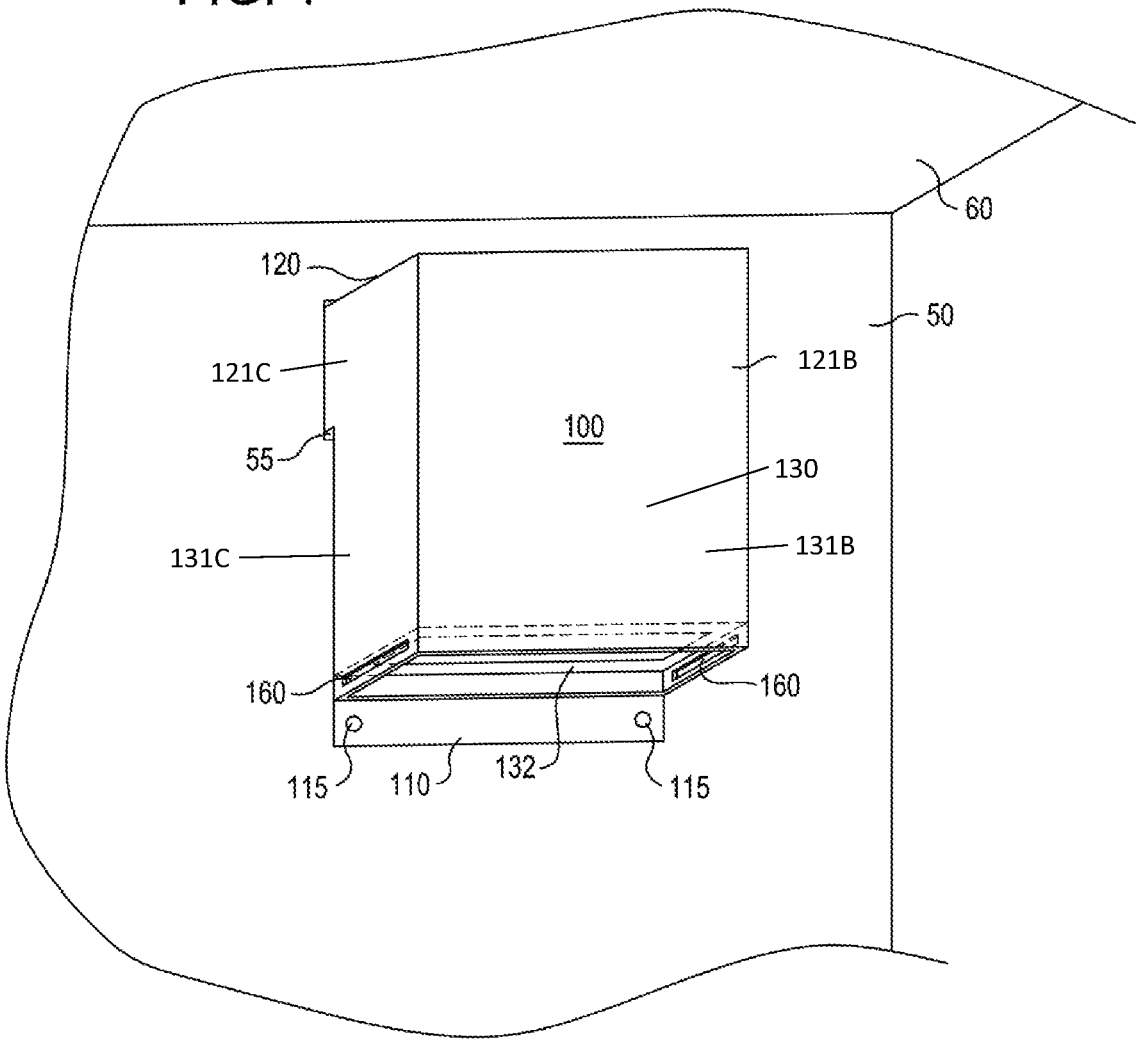
FIG. 1 is a front elevated perspective view of an embodiment of an improved exhaust vent installed on a cutout portion of the exterior wall of a structure disposed beneath an overhead ceiling constructed according to the teachings of the present invention.
Figure 2:
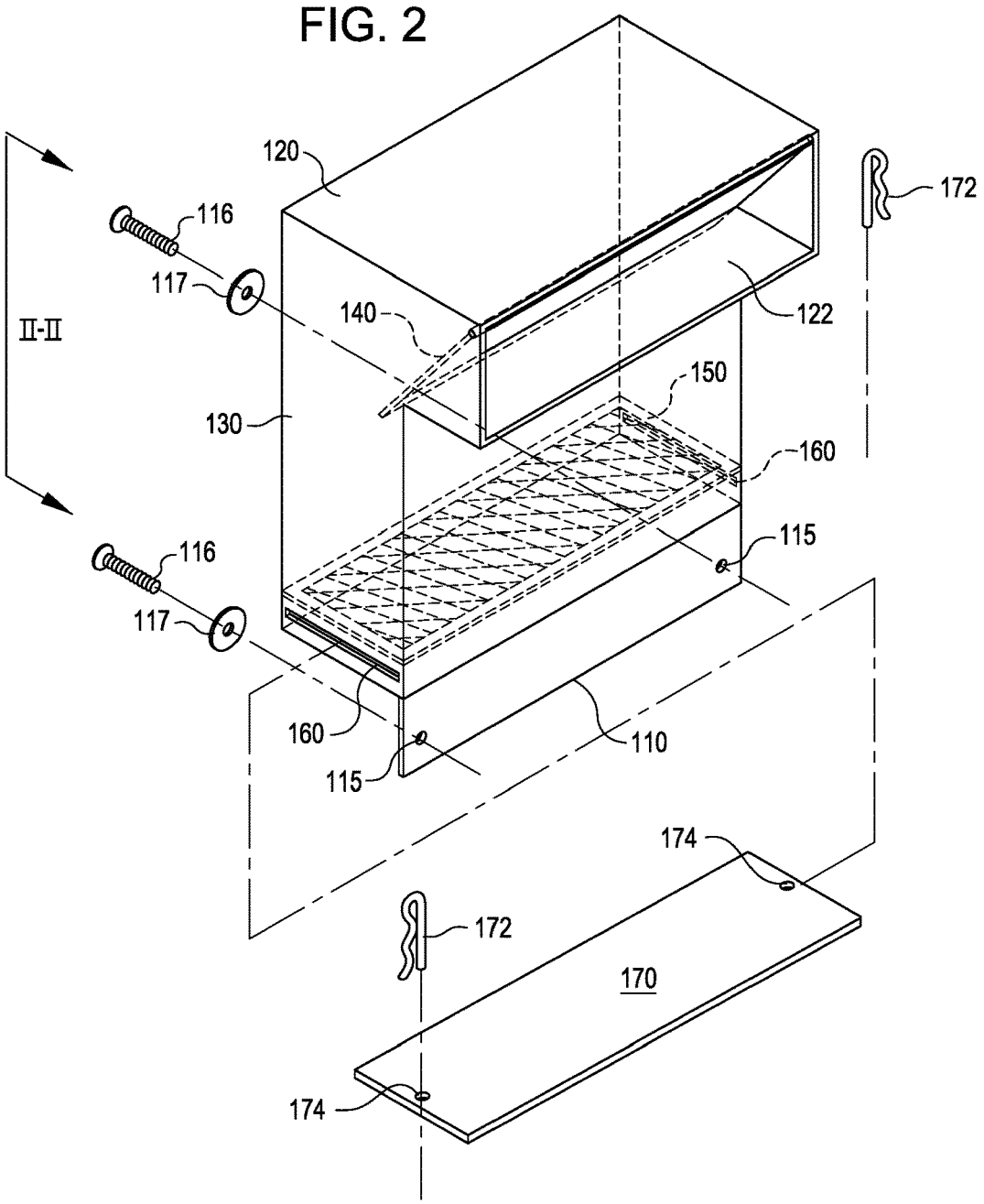
FIG. 2 is a partially exploded elevated right perspective view of the exhaust vent illustrated in FIG. 1.

Referring now to FIGS. 1 and 2, an improved exhaust vent 100 constructed according to the teachings of one embodiment of the present invention is illustrated. The exhaust vent 100 is for use with devices, including but not limited to, appliances (not shown) such as clothes dryers, stoves, microwaves, bathroom and kitchen fans, but adaptable to any other type of appliance needing to vent exhaust air and fumes to the atmosphere. In the illustrated embodiment, the exhaust vent 100 is for installation through a wall 50 of a structure beneath a horizontal overhead 60 such as the lower surface of a balcony where the exhaust vent 100 is protected from water from rain or other source running down the outer wall 50. The exhaust vent 100 may be connected by tubing and ducting 40 (FIGS. 4 and 5) to a first opening 122 (FIGS. 4 and 5) formed by a first portion 120 inserted into an opening 55 in the outer wall 50 of the structure to the appliance and is also in fluid communication with the atmosphere on the exterior of the wall 50. The first opening 122 and the opening 55 in the outer wall 50 have a plane that is substantially co-planar with the vertical plane. A flange 110 at the bottom of a second portion 130 is provided to abut the outer wall 50 and secure the exhaust vent 100 thereto using fasteners such as lag bolts or screws 116 and a washer 117 (FIGS. 4 and 5) through apertures 115. Caulking may be used around the edges of the flange 110 and the outer edges of the first portion 120 around the opening 55 in the outer wall 50 to facilitate preventing water and rain leaks.

Figure 3:
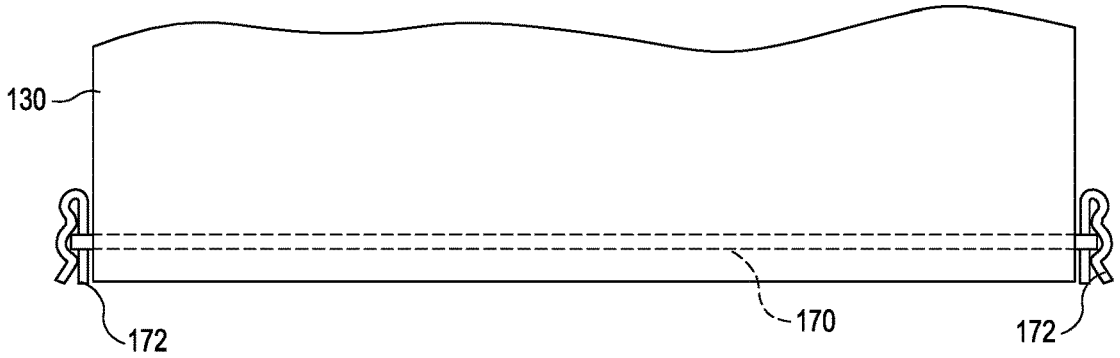
FIG. 3 is a partially cutaway front view of the bottom region of the exhaust vent illustrated in FIG. 1 showing the detail of the installed weather guard near the exterior exhaust opening.
Figure 4:
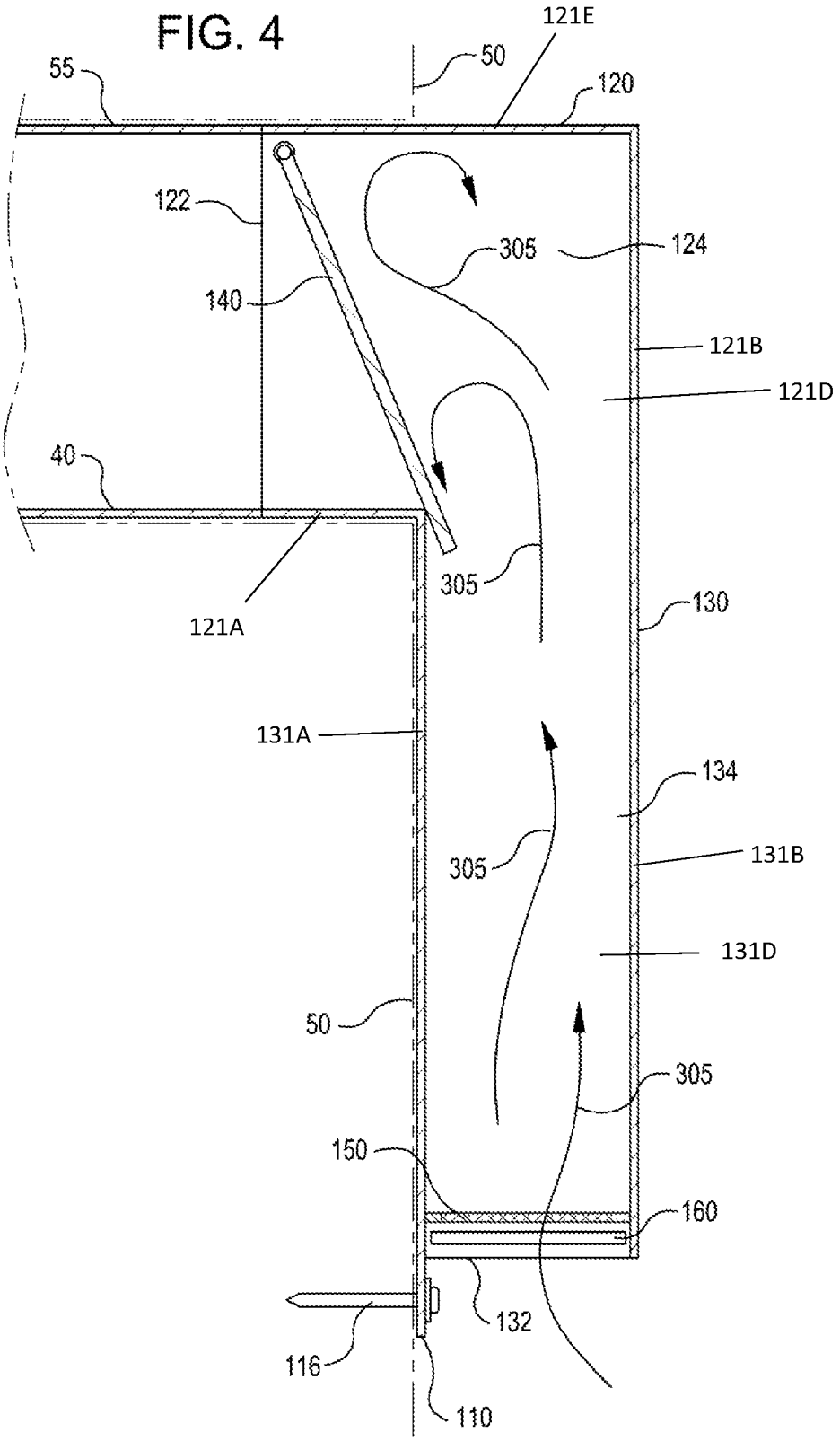
FIG. 4 is a side cross-sectional view of the exhaust vent illustrated in FIG. 1 taken along line II-II of FIG. 2 with the flap in the normally closed position.
Figure 5:
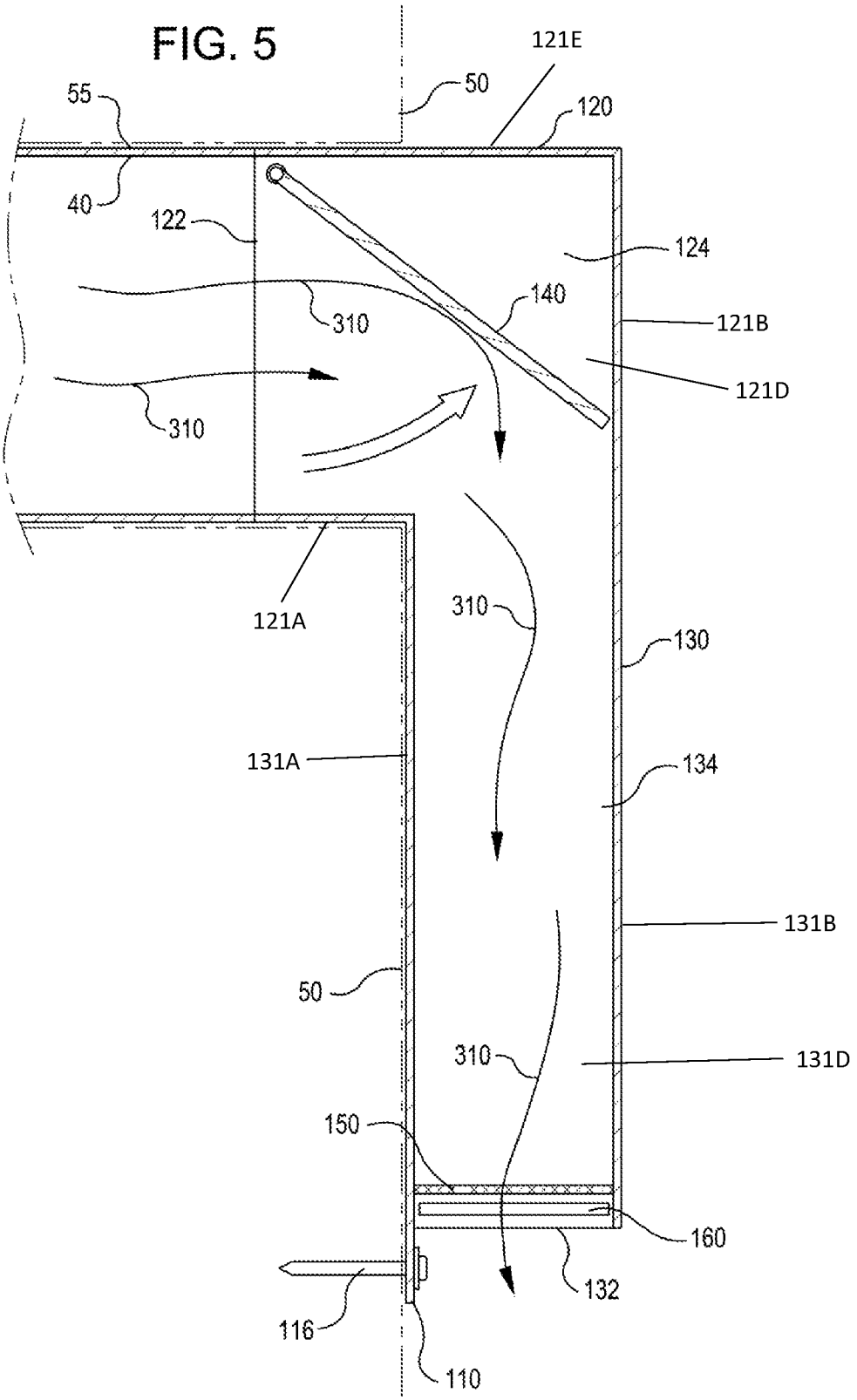
FIG. 5 is a side cross-sectional view of the exhaust vent illustrated in FIG. 1 taken along line II-II of FIG. 2 with the flap in the open position.

Referring now also to FIGS. 3 to 5, the first portion 120 is fluidly connected to the second portion 130 collectively forming a substantially perpendicular duct with a first duct portion 124 and a second duct portion 134 to facilitate directing exhaust air from the appliance downward through a second opening 132 at the bottom end of the second portion 130 into the atmosphere. The second opening 132 has a plane oriented substantially co-planar with the horizontal plane. Alternately, the first and second portions 120, 130 may be fluidly connected together at any other angular configuration as needed. Both the first and second portions 120, 130 may have a rectangular cross-section or other shape. Both the first and second portions 120, 130 and other exhaust vent parts may be made from a more robust material than prior art exhaust ducts of this type for use in environments that suffer from extreme weather such as hurricanes, rain storms, and corrosion from salt laden air. Materials may include steel, stainless steel, aluminum or other metals, or plastics and composites, or virtually any suitable materials.

First portion 120 may be formed from sidewalls 121A, 121B, 121C, 121D and 121E. Second portion 130 may be formed from sidewalls 131A, 131B, 131C and 131D that extend from the first portion 120 to the second opening 132.

Disposed in proximity to the junction of the first and second portions 120, 130 is a hinged flap 140 that is in a normally closed position (FIG. 4) by gravity to seal the first portion 120 from the atmosphere when no exhaust air is being directed through the first duct 124 of first portion 120. Prior art designs typically use a spring to bias such a flap into the normally closed position but such springs often fail over a short time and there is no longer sealing of the exhaust duct to prevent backflow. When exhaust air is being directed from ducting 40 through the first duct 124 of first portion 120 pressure from the exhaust air (see arrows 310) forces the flap 140 into an open configuration (FIG. 5) so that exhaust air is directed into the second duct 134 of second portion 130 (see arrows 310) and further through to the second opening 132 formed at the bottom of the second portion 130 to the atmosphere. When the exhaust air is discontinued being directed from ducting 40 into the first duct 124 of first portion 120, the hinged flap 140 seals the junction between first portion 120 and second portion 130 by gravity to help prevent back airflow (see arrows 305) from the atmosphere and rain through the exhaust duct 100 to the appliance in the structure especially during extreme weather such as hurricanes. There is a screen 150 disposed at the lower end of the second portion 130 to prevent animals, birds or other objects from entering the second and first portions 120, 130 and into the appliance and the structure.

In an embodiment, there are slots 160 formed in the second portion 130 on opposite sides adjacent to the opening 132 that receives a weather guard 170 below the screen 150 that may be inserted into the slots 160 to seal the second opening 132 during extreme weather to further prevent rain, wind and objects from entering the second opening 132. Cotter pins 172 may be used to secure the weather guard 170 into position in the second portion 130 near the second opening 132. The cotter pins 172 are inserted into apertures 174 in the weather guard 170 on opposite sides of the second portion 130 on opposite sides on the exterior sidewalls of the second portion 130 near the second opening 132.

Figure 6:
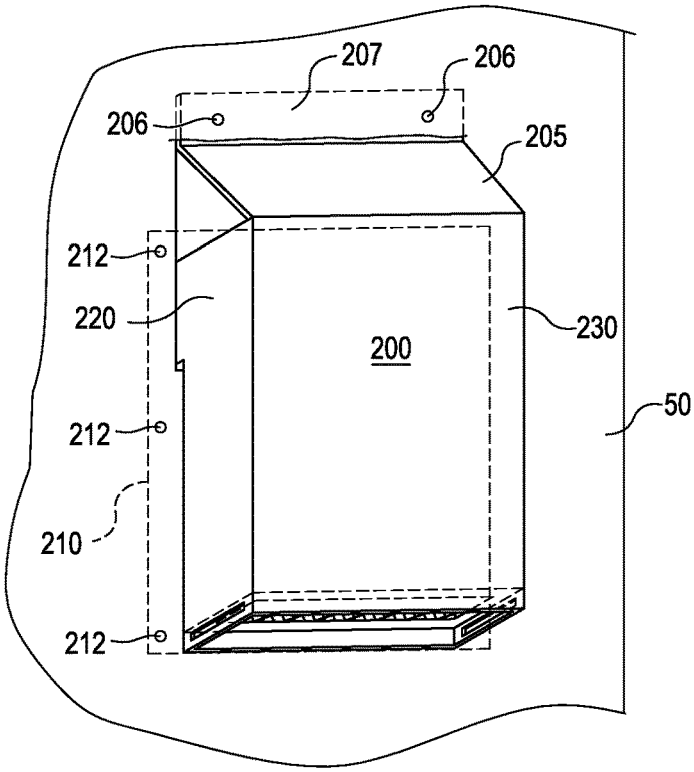
FIG. 6 is front elevated perspective view of another embodiment of an improved exhaust vent installed on a cutout portion of the exterior wall of a structure not disposed beneath an overhead ceiling constructed according to the teachings of the present invention.
Figure 7:
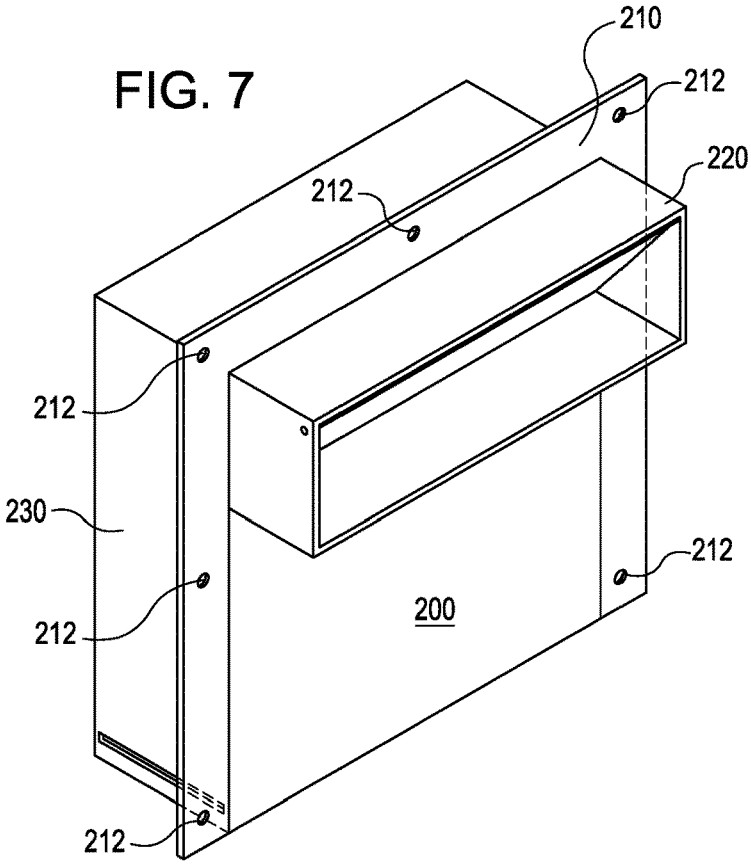
FIG. 7 is rear elevated perspective view of the exhaust vent illustrated in FIG. 6 in the pre-installation configuration.

Referring now also to FIGS. 6 to 7, an embodiment of an exhaust duct 200 is illustrated for installation through a wall 50 of a structure not having a horizontal overhead 60 such as the lower surface of a balcony illustrated in the embodiment of the invention in FIGS. 1 to 5. The exhaust duct 200 is connected to ducting 40 connected to the appliance inside the structure and passes through an opening 55 to the atmosphere as described above and illustrated in FIGS. 1 to 5. In this installation scenario, water from rain or other source may be expected to be running down the outer wall 50 from above the exhaust vent 200. In order to prevent leakage into the structure through the top of the opening 55 in the outer wall 50, the exhaust vent 200 may include a sloping rain and water shield 205 disposed on an upper surface of the first portion 220 that extends to the front of the second portion 230. The rain and water shield 205 fits flush with the outer wall 50 of the structure to deflect rain and water away from the exhaust vent 200 below. The rain and water shield 205 may include flange a flange 207 that is secured to the outer wall 50 with apertures 206 and fasteners such as screws (not shown) before stucco is applied over the flange 207. The remainder of the interior components and functioning of the exhaust duct 200 is identical to the embodiment of the exhaust duct 100 described above and illustrated in FIGS. 1 to 5 except as described below.

In an embodiment, the exhaust vent 200 may include a flange or fin 210 that rings the outer periphery of the first and second portions 220, 230 of the exhaust duct 200 that is installed through the opening in the outer wall 50 of the structure that the first portion 220 extends through. The flange 210 is installed on the outer surface of the outer wall 50 and stucco coating may be subsequently spread over the outer surface of the wall 50 and over flange 210. Apertures 212 are formed in the flange 210 to secure the flange 210 to the outer wall 50 with fasteners such as lag bolts or screws (not shown) before stucco is applied over the flange 210. The flange 210 serves to deflect any water or rain seeping down the outer wall 50 that could otherwise leak through the opening 55 into the structure. Caulking may be used around the edges of the flange 210 on the outer wall 50 and the first and second portions 220, 230 to facilitate preventing leaks.

Thus, there has been shown and described several embodiments of an exhaust vent. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An exhaust vent, comprising:

a first portion inserted through an opening in an outer wall of a structure for fluidly connecting to an appliance to be vented within the structure and having an upper sidewall extending an elongated distance from the outer wall and a lower sidewall;

a second portion fluidly and non-removably connected to the first portion exterior to the outer wall and having an open end downwardly directed and opening into the atmosphere, said first and second portions defining a duct, and said second portion further having at least one substantially elongated exclusively planar rear sidewall that extends from a lower sidewall of the first portion and abuts and parallels the outer wall to the open end of the second portion and an exclusively planar front sidewall spaced apart from and parallel to the rear sidewall;

a flap disposed within the duct normally in a closed position configured to move to an open position by pressure from exhaust air directed through the first portion from the appliance and allow the exhaust air to pass through the second portion and be vented through the open end to the atmosphere; and the rear sidewall of the second portion and the lower sidewall of the first portion are joined together and oriented perpendicularly collectively forming an elongated edge within the duct and in the closed position the flap obliquely rests at a medial point against the edge to seal the duct;

wherein an upper end of the flap is pivotally connected to the second portion of the duct within the outer wall and an opposite end is disposed within the second portion exterior to the outer wall.

2. The exhaust vent of claim 1, wherein the flap is further configured to close by gravity to the closed position to seal the duct defined by the first and second portions when no exhaust air is directed through the first portion from the appliance to prevent airflow from the atmosphere through the open end through the second portion to the first portion.

3. The exhaust vent of claim 1, further comprising the first portion is fluidly connected to the second portion in a substantially perpendicular configuration.

4. The exhaust vent of claim 1, further comprising a screen disposed inside the second portion adjacent the open end for preventing objects from entering through the open end into the second portion.

5. The exhaust vent of claim 4, further comprising a pair of slots formed in opposing sidewalls of the second portion adjacent the open end beneath the screen for receiving a weather guard therein for sealing the open end and preventing wind, rain and debris from entering through the open end and into the second portion.

6. The exhaust vent of claim 5, further comprising apertures formed in opposing ends of the weather guard each receiving a cotter pin for securing the weather guard in the second portion.

7. The exhaust vent of claim 1, further comprising a flange having one or more apertures and extending from a bottom end of the second portion, said flange using fasteners through the apertures for securing the second portion and the exhaust vent to the outer wall of the structure.

8. The exhaust vent of claim 1, further comprising a flange ringing at least a portion of the peripheral edge of the second portion, said flange having one or more apertures using fasteners through the apertures for securing the second portion and the exhaust vent to the outer wall of the structure before stucco is applied to the outer wall and over the flange.

9. The exhaust vent of claim 1, further comprising a sloping shield disposed above the first portion and extending from the outer wall to a front edge of the first portion for deflecting rain and water from the exhaust duct.

10. An exhaust vent, comprising:

a first portion inserted through an opening in an outer wall of a structure for fluidly connecting to an appliance to be vented within the structure and having an upper sidewall extending an elongated distance from the outer wall and a lower sidewall;

a second portion fluidly and non-removably connected to the first portion exterior to the outer wall and having an open end opening into the atmosphere, said first and second portions defining a duct, and said second portion further having at least one substantially elongated exclusively planar rear sidewall that extends from of a lower sidewall of the first portion and abuts and parallels the outer wall to the open end of the second portion and an exclusively planar front sidewall spaced apart from and parallel to the rear sidewall;

a flap disposed within the duct configured to open by pressure from exhaust air directed through the first portion from the appliance and allow the exhaust air to pass through the second portion and be vented through the open end to the atmosphere; and the rear sidewall of the second portion and the lower sidewall of the first portion are joined together and oriented perpendicularly collectively forming an elongated edge within the duct and in the closed position the flap rests obliquely at a medial point against the edge to seal the duct;

wherein the flap is further configured to close by gravity to seal the duct defined by the first and second portions when no exhaust air is directed through the first portion from the appliance to prevent airflow from the atmosphere through the open end through the second portion to the first portion and an upper end of the flap is pivotally connected to the second portion of the duct within the wall and an opposite end is disposed within the second portion exterior to the outer wall.

11. The exhaust vent of claim 10, further comprising the first portion is fluidly connected to the second portion in a substantially perpendicular configuration.

12. The exhaust vent of claim 10, further comprising a screen disposed inside the second portion adjacent the open end for preventing objects from entering through the open end into the second portion.

13. The exhaust vent of claim 12, further comprising a pair of slots formed in opposing sidewalls of the second portion adjacent the open end beneath the screen for receiving a weather guard therein for sealing the open end and preventing wind, rain and debris from entering through the open end and into the second portion.

14. The exhaust vent of claim 13, further comprising apertures formed in opposing ends of the weather guard each receiving a cotter pin for securing the weather guard in the second portion.

15. The exhaust vent of claim 10, further comprising a flange having one or more apertures and extending from a bottom end of the second portion, said flange using fasteners through the apertures for securing the second portion and the exhaust vent to the outer wall of the structure.

16. The exhaust vent of claim 10, further comprising a flange ringing at least a portion of the peripheral edge of the second portion, said flange having one or more apertures using fasteners through the apertures for securing the second portion and the exhaust vent to the outer wall of the structure before stucco is applied to the outer wall and over the flange.

17. The exhaust vent of claim 10, further comprising a sloping shield disposed above the first portion and extending from the outer wall to a front edge of the first portion for deflecting rain and water from the exhaust duct.

18. An exhaust vent, comprising:

a first portion inserted through an opening in an outer wall of a structure for fluidly connecting to an appliance to be vented within the structure and having an upper sidewall extending an elongated distance from the outer wall and a lower sidewall;

a second portion fluidly and non-removably connected to the first portion exterior to the outer wall and having an open end, said first and second portions defining a duct, and said open end downwardly directed into the atmosphere and having a plane oriented substantially horizontally, said second portion further having at least one substantially elongated exclusively planar rear sidewall and an exclusively planar front sidewall spaced apart from and parallel to the rear sidewall;

a flap disposed within the duct normally within a closed position by gravity to seal the duct, said flap configured to move to an open position by pressure from exhaust air directed through the first portion from the appliance and allow the exhaust air to pass through the second portion and be vented through the open end to the atmosphere; and the rear sidewall of the second portion and the lower sidewall of the first portion are joined together and oriented perpendicularly collectively forming an elongated edge within the duct and in the closed position the flap rests obliquely at a medial point against the edge to seal the duct;

wherein an upper end of the flap is pivotally connected to the second portion of the duct within the outer wall and an opposite end is disposed within the second portion exterior to the outer wall.

* * * * *